US005617657A

United States Patent [19]

Kahn

[11] Patent Number: 5,617,657

[45] Date of Patent: Apr. 8, 1997

[54] MULTI-COLOR LIQUID DISPLAY SYSTEM

[76] Inventor: Jon B. Kahn, 3002 Stargrass Ct., League City, Tex. 77573

[21] Appl. No.: 592,923

[22] Filed: Jan. 29, 1996

[51] Int. Cl.[6] ..... G09F 19/00

[52] U.S. Cl. ..... 40/406; 40/407; 239/17

[58] Field of Search ..... 40/406, 407; 137/154; 446/267; 239/17, 18, 20, 23

[56] References Cited

U.S. PATENT DOCUMENTS

| | | | |
|---|---|---|---|
| 2,145,747 | 1/1939 | Askew | 40/406 |
| 2,621,430 | 12/1952 | Neville | 40/406 X |
| 2,645,048 | 7/1953 | Adams | 40/406 X |
| 4,144,663 | 3/1979 | Saenger et al. | 40/406 |
| 5,075,992 | 12/1991 | Kahn | 40/406 |

*Primary Examiner*—Brian K. Green
*Attorney, Agent, or Firm*—Marvin J. Marnock

[57] ABSTRACT

A multi-color liquid display system comprising a transparent conduit and system for sequentially circulating liquids of different color and different specific gravity through the conduit to present a dynamic display such as "raining" of one liquid into another. The circulating system includes a reservoir, a pump, device for communicating liquids in the reservoir with the transparent conduit, and device for controlling the proportionate flow of the different colored liquids from the reservoir. The display system includes a panel assembly in which a front transparent panel is bonded to a second transparent panel in spaced relation thereto and the conduit for liquids is formed in a desired configuration between the panels. The sign is illuminated by back lighting and the front panel is coated to mask all but the portions of the sign to be illuminated. The corridor can be configured with an enlarged chamber and a narrower contiguous portion with openings to the chamber whereby a first circulated liquid is received in the chamber and portions of a second different colored liquid are flowed into the chamber to simulate "raining" therein.

7 Claims, 7 Drawing Sheets

MULTI-COLOR LIQUID DISPLAY SYSTEM

FIELD OF THE INVENTION

This invention relates to a multi-color liquid display system and more particularly to a display system which includes a display device such as a sign which is connected in a fluid circulating system wherein liquids of different colors and specific gravities in the fluid circulating system are adapted to be pumped in sequence therethrough to simulate the "writing out" of the sign and to produce other effects such as the "bubbling" of one colored liquid into a portion of the sign which includes a different colored liquid.

BACKGROUND OF THE INVENTION

There are a variety of display systems which rely on the change of color for presenting a dynamic and colorful display. In the art of electric "writing" signs, for example, one common technique has been to use control of the sign's electrical power to "write-out" the sign as it is progressively illuminated from one end to the other. However, a disadvantage is that the sign is only one color, and may be only partially visibly illuminated at any one instant.

There are other systems which make use of different colored or differently illuminated liquids for providing a colorful display. For example, there are devices which comprise an illuminable gas tube with a liquid pipe in overlapping relationship and a circulating system for alternately flowing liquids of different colors through the liquid pipe. In these devices, the alternation is effected by multiple pumps and/or valves controlled by complex electro-mechanical mechanisms to effect the alternate flows. In U.S. Pat. No. 5,075,992 there is shown a fluid circulating system for sequentially circulating different colored liquids through a liquid conduit to produce a visual display as a "writing sign" wherein a transparent conduit for carrying liquid is illuminated by luminous tubing encased in coaxial relation therein. The fluid circulating system includes a reservoir tank, a pump, a metering chamber and a dispensing chamber below the metering chamber, ducts for fluidly communicating the different strata of liquids in the reservoir with the metering chamber, and a siphon line and an air breather line which interconnect the metering chamber with the dispensing chamber. The design, however, tends to produce mixing of air with the circulating liquids and some mixing of the liquids themselves which diminishes the contrast of the colored liquids and blurs the line of separation therebetween as they are circulated through the system.

SUMMARY OF THE INVENTION

The present invention relates to a multi-color liquid display system which comprises a transparent conduit for liquids and a fluid circulating system for circulating different colored liquids through the conduit in sequence to present a dynamic display such as simulating the "writing out" of the sign or the "raining" of one liquid into another. The fluid circulating system which connects in communication with the entry end of the transparent liquid conduit and also to its exit end includes a reservoir tank, a pump connected in the circulating system between the exit end of the liquid conduit and the reservoir, means for fluidly communicating the different liquids in the reservoir with the transparent liquid conduit, filter means connected in communication with the outlet of the pump and the reservoir tank for filtering the fluids in said fluid circulating system, and a valve means for controlling the proportionate flow of the liquids from the reservoir tank. The conduit for liquids is formed between the transparent panels of a panel assembly in which a front transparent panel is bonded to a second transparent panel in spaced relation so as to create an offset distance therebetween. The corridor or conduit for liquids is formed between the panels by an adhesive bead system or set of panel ridges arranged in a desired configuration. The sign is illuminated by back lighting in the rear of the panel assembly and the front surface of the front panel is coated with opaque material to mask all but the lettering and other portions of the sign which are to be illuminated.

DETAILED DESCRIPTION OF THE INVENTION

Figure 1:
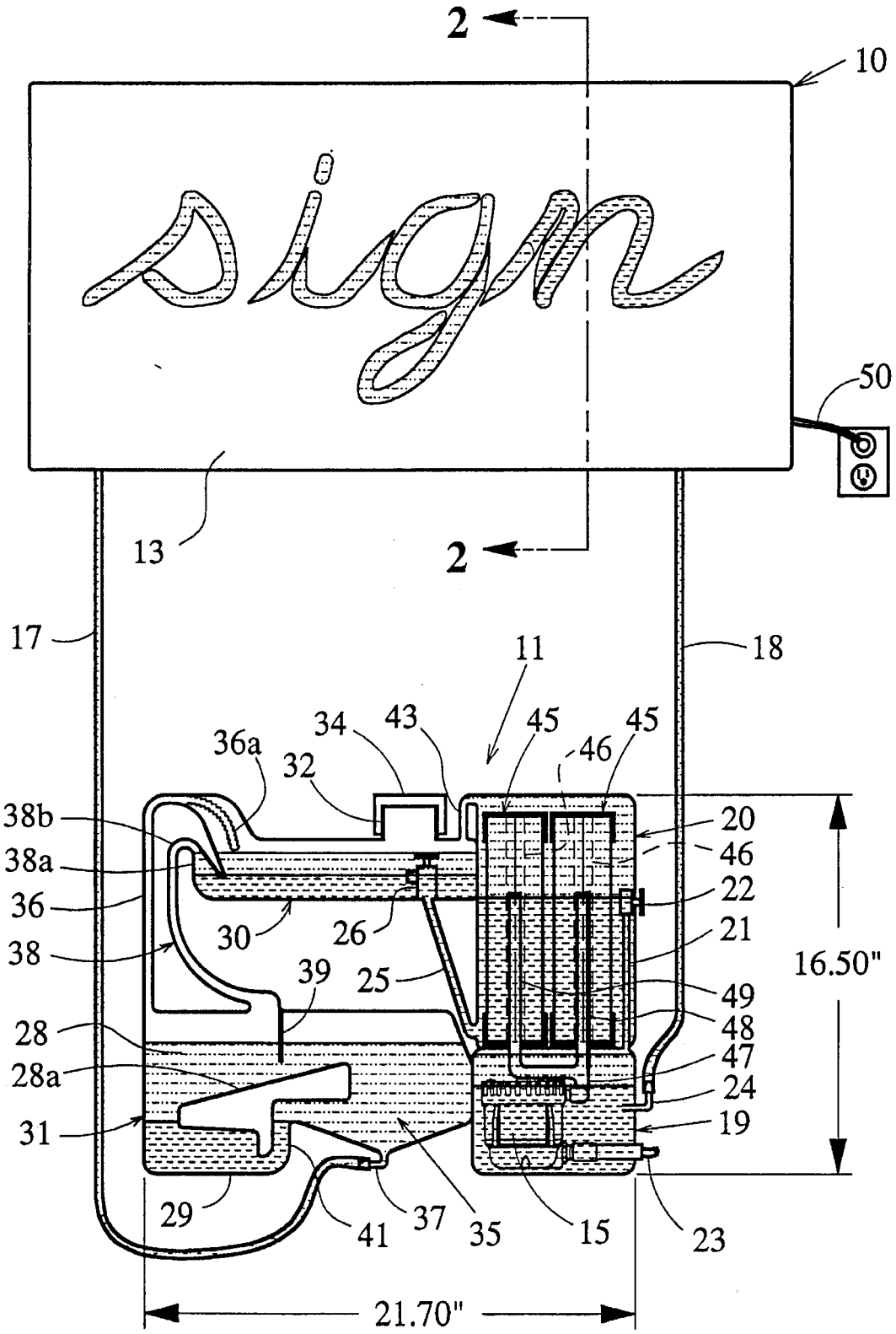
FIG. 1 is a plan schematic view of an embodiment of the invention which comprises a back-lit sign and an associated fluid circulating system connecting thereto in accordance with the invention and wherein parts of the circulating system are shown in cross section.
Figure 2:
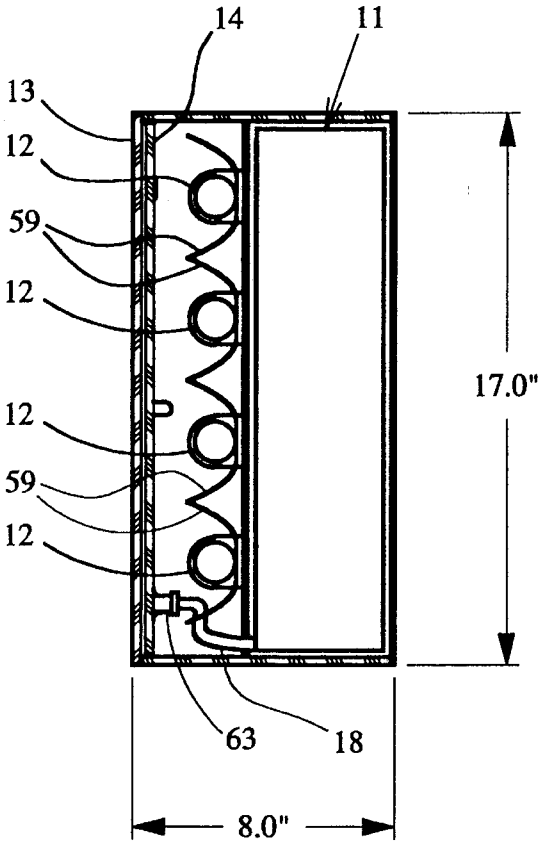
FIG. 2 is an enlarged transverse cross section of the sign component of the invention as taken along the section line 2—2 in FIG. 1 and showing the fluid circulating apparatus located behind the sign.
Figure 4:
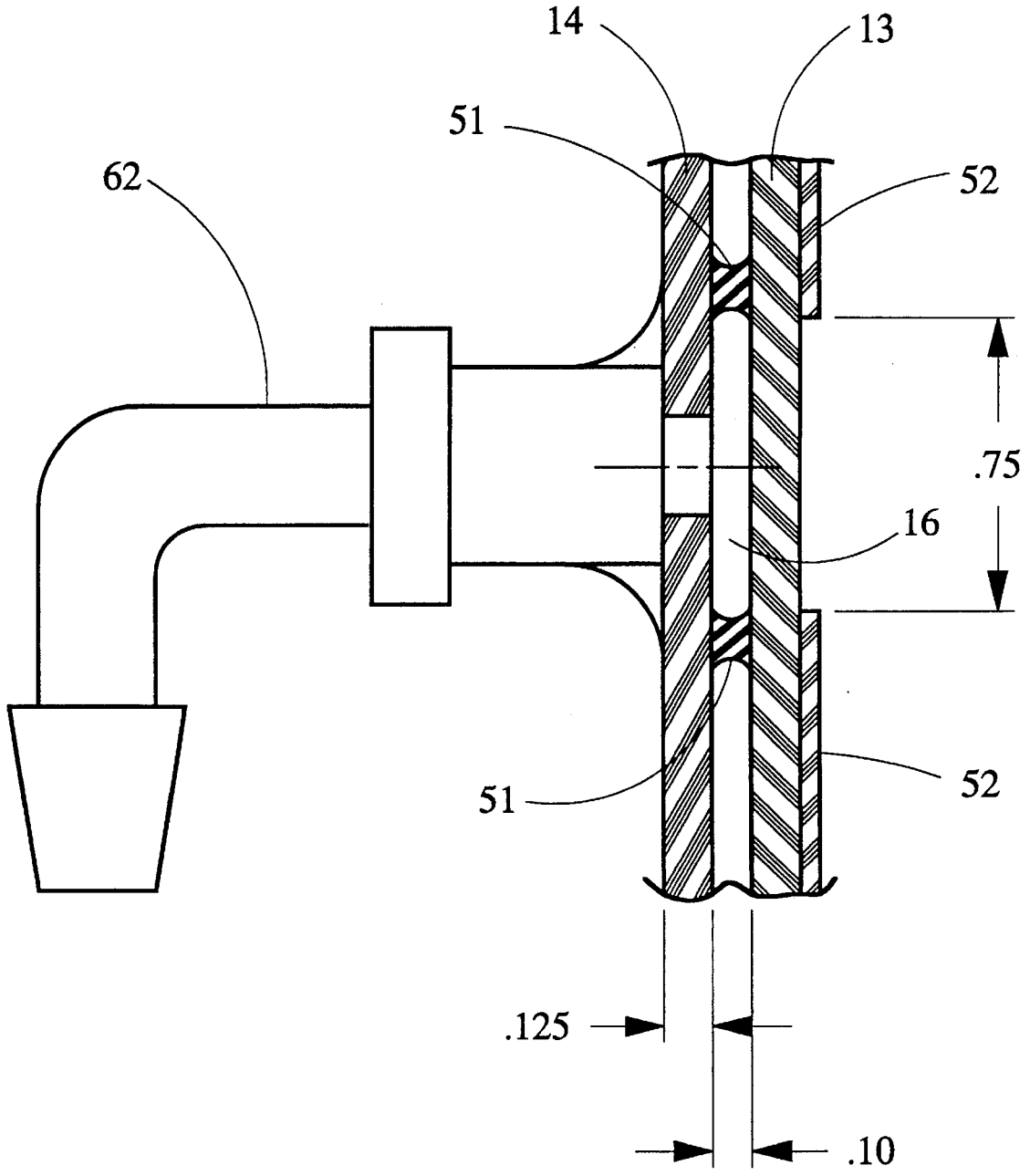
FIG. 4 is a fragmentary cross section as taken along the section line 4—4 in FIG. 3 and showing the panel assembly which defines a fluid corridor through which different colored liquids are adapted to be circulated in sequence by the fluid circulating system of the invention.

Referring more particularly to the drawings, there is shown in FIG. 1 an embodiment of the invention which includes a display in which the word "sign" is depicted in script form and an associated fluid circulating system 11 is operatively associated therewith. The sign component of the invention is a back-lit sign 10 which uses a number of fluorescent lamps 12 mounted behind an assembly of transparent panels 13, 14 bonded to one another in closely spaced parallel relation as shown in FIG. 2. A fluid corridor 16 is created in the space between the panels, as shown in FIG. 4, in a manner to be hereinafter described and provides the display sign 10. The fluid corridor 16 is shown configured in script form but may have substantially any configuration desired. The fluid circulating system includes the sign 10 which is provided with an entry conduit line 17 at one end of the sign and an exit conduit line 18 which connects to the other end of the sign. If convenient, all of the fluid circulating apparatus may be mounted directly behind the sign.

The function of the fluid circulating system 11 which is powered by a centrifugal pump 15 is to pass colored liquid from a reservoir chamber or tank 20 through the fluid corridor 16 in the transparent panel assembly. In the system structure, the tank 20 is seated atop a pump chamber 19 in which the pump 15 is placed. The chamber 19 accommodates the pump 15 with room to spare, being approximately three times greater than the pump 15. The chamber 19 is also provided with side openings to accommodate passage of an electrical conduit 23 for powering the pump 15 and an inlet barb 24 which provides a fitting for connecting the exit conduit 18 from the sign 10. By using two immiscible liquids of different colors and specific gravities, such as oil and water, the system functions to circulate the different liquids through the sign in alternation, such that as one liquid begins to fill the sign as the other liquid is expelled therefrom, the sign changes its color progressively, along its length from one end to the other, thereby simulating the "writing-out" of the sign.

While the centrifugal pump 15 has an advantage of low-cost and high life span, it often poses a problem when used to provide a suction system in an extensive and intricate liquid circulating system. For example, when the resistance to flow created by a long and complex path in the letters of the sign 10 is of a certain level, the impeller of the pump will begin to cavitate and lose its ability to pump properly. The solution in the present invention is to incorporate a bypass conduit 21 between the pump chamber 19 and the reservoir 20 so as to allow the liquids to flow directly into the pump chamber 19 without the resistance of the sign letters. Since flow must be controlled to insure that some fluid will pass through the sign, the bypass flow is adjusted to a level of compromise which maximizes flow through the sign but prevents cavitation. For this purpose a manual adjustment valve 22 is attached to the conduit 21. The valve 22 needs adjustment only once, but can be used later as a technique to slow the flow through the sign if so desired.

Another key function of the bypass conduit 21 is to allow accumulated air to leave the pump chamber 19 periodically when the circulating system is turned off. During system operation, the motion of fluids through the fluids circulating apparatus and the sign 10 causes a small amount of aeration to occur, trapping minute air bubbles in the liquids. When the liquids enter the lower pressure of the pump chamber 19 a certain amount of these air bubbles are released from the liquids and accumulate in the top of the pump chamber. After the trapped air begins to fill a significant volume of the pump chamber, the liquid level in the chamber 19 will drop until air begins to be drawn gradually into the pump intake along with the liquids. While this rate of air accumulation is not enough to disable the pump 15, it does increase the level of noise generated by the pump and also decreases the life span of the pump.

To alleviate this problem, the pump chamber 19 is designed with enough volume to allow air accumulation to occur without dropping the fluid to this level over a normal operating period, such as twelve hours. When the pump 15 is turned off, the pressure of the liquids in the reservoir 20, being above the pump chamber 19, will backflow through the pump 15 and force the air through the bypass conduit 21 into the reservoir chamber 20. This takes only several seconds, after which the system is returned to its original state of no air in the pump chamber 19.

The bypass valve 22, being set at a relatively small orifice opening, creates a resistance to this air flow which could prevent the small pressure differential between the reservoir and pump chambers from allowing this recycling to occur. This potential problem is solved by placing the bypass valve 22 at a higher level than the top of the pump chamber 19 which places the valve 22 at a lower pressure level in the reservoir. The bypass conduit 21 below the valve 22 is also provided with a sufficient diameter to prevent surface tension from trapping liquid inside the conduit once air begins to accumulate in the pump chamber 19.

Another reason for the valve 22 to be placed at such a height is that by being in a position just above the top surface of the water or other heavy liquid in the reservoir 20, only the lighter liquid, such as oil, and not the heavier liquid, is drawn through the bypass conduit 21. This serves to help maintain clarity in the water by minimizing the proportion of water in the ratio of heavy liquid and light liquid inside the pump's impeller chamber, the oil not being susceptible to the same clarity/aeration problem as is the water.

As previously noted, the air accumulation in the pump chamber 19 requires a certain requisite chamber volume to prevent air intake in the pump 15 during a normal operating period. While this requires a larger pump chamber 19 than would otherwise be necessary, it is also a requirement that the additional volume must be provided above the intake of the pump 15 in order to be of benefit.

In addition to the reservoir tank 20 and pump 15, the fluid circulating system of the invention includes a metering chamber 30, located such that the height of its bottom is at least equal to the height of the bottom of the reservoir tank 20. However, the top of the metering chamber must be below the top of the reservoir 20. The system also includes a pair of dispensing chambers comprising an upper dispensing chamber 28 and a lower dispensing chamber 29. The dispensing chambers 28, 29 are located below the metering chamber 30.

The metering chamber 30 is connected in fluid communication with the reservoir chamber 20 by means of a duct 25 which opens into the reservoir chamber 20 near the bottom thereof and extends through the bottom of the metering chamber. At its upper end, the duct 25 is fitted with a ratio valve 26. When the circulating system is filled with the requisite amount of liquids and is placed in operation with the valve 26 fully open, only the heavier liquid will flow through the valve 26 from the reservoir 20 to the metering chamber. When partially open, some heavy liquid will flow through the valve 26 and lighter liquid will be drawn into the metering chamber through tube 43 which connects to the top of the reservoir chamber and to the top of the metering chamber. The relative proportions of the flows will be controlled by the ratio valve 26.

The metering chamber 30 is also provided with a tubular neck 32 which extends from the top thereof and is provided with external threading for accommodating a fill cap 34 which may be threaded thereon. The metering chamber 30 is also connected in communication with the upper dispensing chamber 28 by an external air line or breather conduit 36. The breather line 36 is connected to open into the top of the dispensing chamber 28 and extends vertically along the outside of the metering chamber 30 and is curved at its upper end to provide the breather line with a downwardly extending end portion **36*a* in the form of a semi-rigid metallic corrugated tube which extends into the metering chamber at the top thereof. Accordingly, the height of the open tip of the breather line portion 36*a*** is adjustable to the needed height level in the metering chamber by bending the flexible end portion in the desired direction. The height of the open tip of the breather line determines the quantity of liquid to be cycled through the sign.

A siphon conduit line 38 is also attached to the metering chamber 30 in a manner which establishes fluid communication between the metering chamber 30 and the upper dispensing chamber 28. The siphon line 38 is curved at its upper end to provide a downwardly extending portion 38*a* which extends downwardly into the metering chamber 30 through an opening provided in the top thereof. The design is such that the lower open end of the siphon extension 38*a* is below the open end of the breather fine extension 36*a*.

Since liquids of different color and different specific gravity are to be circulated through the system in sequence, it is particularly important that the division between the two liquids be particularly refined and the transition of liquids through the system components be smooth.

In the circulating system disclosed in U.S. Pat. No. 5,075,992 the liquids exit the siphon into the dispensing chamber at a relatively high rate which tends to mix the liquids and produce aeration. The liquids therefore do not exit the dispensing chamber to the sign entry conduit with a distinctive transition between colors. Hence, to create a more smooth switch between the two liquids and to allow air bubbles more time to escape, the fluid circulating system of the present invention includes the lower dispensing chamber 29 in addition to the upper dispensing chamber 28.

As will be seen in FIG. 1, the upper dispensing chamber 28 has a bottom 28*a* which is declined downwardly to a chamber extension which constitutes an initial dispensing funnel 31. The funnel 31 extends downwardly to connect the upper dispensing chamber 28 with the lower dispensing chamber 29. Adjacent to the high end of the inclined bottom 28*a*, the upper chamber is also provided with a second downward extension which constitutes a final dispensing funnel 35, the bottom end of which is fitted with an outlet 37 for connecting the entry conduit line 17 to the sign 10. Further by means of an overflow conduit 41, the chamber extension which forms the final dispensing funnel 35 communicates with the lower dispensing chamber 29.

When the liquids exit the siphon, they flow against a deflector wall 39 which extends downwardly from the chamber 28 and is offset from the outlet of the siphon and into a downward-ramped portion of the chamber 28, hereinafter referred to as the initial dispensing funnel 31. From this point, the heavy liquid, hereinafter referred to as water, flows through the bottom end of the initial dispensing funnel and into the lower dispensing chamber 29. The greater part of this lower dispensing chamber is always filled with the water. The upper dispensing chamber 28 and final dispensing funnel 35 are normally filled with the lighter liquid, oil. When the cycle of water enters the lower dispensing chamber 29, it displaces the water already occupying that volume and forces it to overflow through the overflow conduit 41 into the final dispensing funnel 35.

It is to be noted that as the overflow of water from the lower dispensing chamber 29 is in process and the water level in the initial dispensing funnel 31 is dropping, the rate of overflow and the flow of water into the final dispensing funnel 35 decreases. To insure that the flow of water into the funnel 35 keeps up with the demand imposed by the normal flow of liquid through the sign, it is provided that the overflow conduit 41 from the lower dispensing chamber 29 opens into the funnel 35 at a location which is below the mid-point of the height of the initial dispensing funnel 31. Accordingly, the greater volume of heavy liquid in the funnel 31 above the outlet of conduit 41 to the final dispensing funnel 35 creates a pressure differential which increases the flow rate into the funnel 35.

It is also to be seen that the amount of liquid surface area at the same height as the overflow point affects the rate at which the overflow causes the water level to drop. The smaller this surface area, which effectively is the sum of the cross-sectional areas of the funnel conduits connecting the upper and lower dispensing chambers, the more rapid the drop in the water level and the cleaner the cut-off of water over the overflow point. For this reason, the ceiling of the lower dispensing chamber 29 is positioned slightly below the upper opening of the overflow conduit 41 to reduce such surface area and thereby insure a cleaner transition between the water and oil.

The siphon action, which is the key control in cycling the two different colored liquids, is terminated each cycle when the liquid level in the metering chamber 30 drops below the intake of the siphon 38. If the drop-rate of the liquid level in the metering chamber is not quick enough, the siphon will draw air along with the liquids and the siphon action will not be terminated properly. Accordingly, to enhance the cut-off of the siphon action by the intake of air, the inlet of the siphon line is enlarged relative to the cross-sectional area of the siphon line. Although this does not effect the process which begins the siphon because the siphon action starts when the liquid level is above the siphon intake, it does, however, cause a desired rapid termination of the siphon action when the liquid level in the metering chamber 30 drops below the siphon inlet. This happens because the additional volume of liquids trapped in the enlarged intake volume has an increased tendency to reverse flow when faced with a lower pressure caused by the lower liquid level outside the siphon inlet.

It is to be appreciated, that the greater the diameter of the siphon line, the faster is the siphon flow rate, and therefore the more time allowed for the dispensing chamber action to create a smooth transition between liquids. On the other hand, if this diameter is too large, the flow rate created by the pump will not be large, and will not be large enough to sufficiently fill the siphon line completely with liquids and will therefore never begin the siphon action. The compromise to make for a faster siphon, is a gradual increase in the diameter of the siphon line in the downward direction of flow. The upper portion of the siphon, at the 180 degree bend 38*b* at the top of the siphon line, must be of sufficiently small diameter to allow the liquid flow from the pump to displace all air in the siphon line 38 as the liquids flow through. Accordingly, the siphon line, beginning at a point slightly below the bend 38*b*, is gradually increased in diameter in the direction of the siphon exit so that the further through the siphon the liquids progress, the higher the flow rate. This is because the lower the position of the leading edge of the liquids, the greater is the pressure differential between it and the pressure supplied by the liquids in the metering chamber 30, which is a function of the height of the liquid surface in the chamber 30.

It is also to be appreciated that the larger the final diameter of the siphon line 38 at its exit end, the greater is the rate of the siphon flow due to the increased effect of the pressure differential on liquids in the chamber 30 and the siphon. The greater the increase in the siphon diameter, the larger is the final diameter, and the better is the design. However, the gradual increase in the siphon line diameter must be limited to a value which does not trap air in the siphon as this would terminate its functions below the point at which air is trapped. This gradual increase in siphon line diameter can be continued to make for a larger final diameter if the overall length of the siphon line is increased. Since height of the overall fluids circulating apparatus must be kept to a minimum to make for convenient stowage, the siphon line length should not be increased by simply increasing the height of the entire system. The siphon line length can however be increased without penalty by curving the siphon line over a convenient span. This allows for a larger final siphon diameter and thus a faster siphon flow rate.

Curving the siphon line brings an additional advantage in the way the liquids are delivered to the dispensing chamber. When the liquids exit the siphon at a relatively high speed, they cause a mixing action at the surface of liquid already present in the dispensing chamber 28. This mixing action must be minimized due to the aeration problem and oil/water mixing. By curving the siphon, the exit point is nearly parallel, rather than perpendicular, to the surface of the liquids in the dispensing chamber 28 and a portion of the dynamic energy of the liquids exiting the siphon is absorbed by impact with the deflector wall 39 of the dispensing chamber 28 thus reducing the energy involved in the mixing when the liquids from the siphon flow contact the liquid in the dispensing chamber.

This deflector wall 39 is designed to direct the flow of the liquids toward the center of the upper dispensing chamber bottom 28*a*. This is important because if the liquids were to flow down directly into the initial dispensing funnel, the oil which is also exiting the siphon along with the water will be forced into the lower dispensing chamber 29 and block the water from flowing down at the rate which is required to provide a sufficient water overflow into the final dispensing funnel 35. The deflector wall 39, by spreading the flow over a wider area in the upper dispensing chamber 28, allows time for the oil to be buoyed upward out of the way as the water is flowing down the initial dispensing funnel 31.

The function of the fluid circulating system 11 is to pass-colored liquids through the corridor 16 in the panel assembly. To prepare the circulating system for operation, the filler cap 34 is removed and the lighter liquid, such as "red" oil, in the typical amount of one and one-half gallons is dumped into the metering chamber 30 through the neck 32 of the metering chamber 30. Some of the oil passes through an opened ratio valve 26 into the reservoir chamber. Approximately one gallon of water is then poured through the neck 32 of the metering chamber, such that the liquids in the tank 20 rise above the opened bypass valve and the open ends of the conduit branches 48, 49 connecting to the outlet from the pump 15, thereby introducing liquids into the pump chamber. When the filler cap 34 is replaced and establishes a fluid tight, seal with the neck 32, the air breather line 36 allows the interchange of air between the chambers 28 and 30 as variations occur in the quantity of liquid which is present in the chambers. The pump 15 is then placed in operation for a time sufficient to circulate the liquids into the sign 10.

Typical dimensions for a preferred embodiment of the invention are shown in FIGS. 1 and 4, wherein the fluid circulating apparatus exclusive of the sign is shown to be 16.5 inches high and 21.7 inches wide. The transparent panels 13, 14 are each 0.125 inches thick with a spacing therebetween of 0.10 inches. The corridor 16 is defined by the bead tracks 51 which are 0.75 inches apart. It also has a thickness or depth of 0.125 inches as defined by the spacing between the panels 13, 14.

The pump 15 is then placed in operation and pumps the liquids from the dispensing chamber 28 through the entry line 17 into the fluids corridor 16 of the sign to the exit line 18 such that the respective liquids are distributed in the system as illustrated in FIG. 1. The location of the pump 15 immediately after the sign establishes a suction system for drawing the liquids through the sign rather than pushing the liquids therethrough and avoids fluid mixing inside the pump from destroying the contrast and sharp division of colors in the sign as could occur were it to be located immediately before the sign.

The centrifugal pump 15 creates a violent mixing action between the oil and water which is highly undesirable. To counteract this mixing, it has been found that a filter system connected to the outlet of the pump is required in separating the oil and water. Filament-wound sediment filters 45 with a porosity just large enough to allow passage of the dye particles in both the oil and water provide a low-cost solution to the mixing problem. A pair of filters 45, each in a cylindrical configuration of circular cross section with a coaxial passage 46 extending therethrough stand on end in the reservoir tank 20. The pump outlet conduit 47 is connected to the tank 20 and open-ended branches 48, 49 extend past way into the filters 45 through the coaxial passages 46. The action of forcing the liquids through the filter material removes the majority of the foaming action which occurs in the pump. The larger the total surface area of the filters, the less the resistance to flow, and therefore the higher the flow rate of the liquids through the sign. Without filtration, the centrifugal pump would produce primarily an oil/water foam which would fill the entire reservoir in a matter of seconds. A commercially available filter which is acceptable for this purpose is the FULFLO Honeycomb cartridge. FULFLO Honeycomb wound depth cartridges are made by diagonally winding a precise pattern of carefully selected fibers, typically cotton or propylene windings, on a hollow core of stainless steel or propylene, which defines a coaxial passage 46 perforated core. The pattern is designed to create hundreds of identical, tapered, spiral passageways. Fibers are combed across these passageways and locked in place by succeeding layers. Solid particles are removed by entrapment in filter media throughout the depth of the entire cartridge.

The conduits 48, 49 inside the filters are extended to a height above the water/oil interface in the tank 20. The reason for this is so that when the system is turned off and the trapped air in the pump chamber bubbles up into the reservoir 20, the oil (and not water) is drawn down in a backflow into the pump chamber through the pump. This is required to prevent the water/oil ratio in the impeller chamber of the pump from being too high for the reason stated previously.

It is also to be appreciated that the height adjustment system used for controlling the ratio of oil and water in the metering chamber in the circulating system disclosed in U.S. Pat. No. 5,075,992 is very sensitive to changes in the flow rate. A more stable control is to use adjustable flow restriction of one or both of the liquids. A low-cost needle valve for the ratio valve 26 on the water conduit 25 from the reservoir 20 provides a convenient method for quickly adjusting the flow rate of the water relative to the oil flow rate. This adjustment needs to be made only once. The flow rate of the oil is naturally restricted by the height differential between the oil conduit 43 and the water conduit 25.

Figure 3:
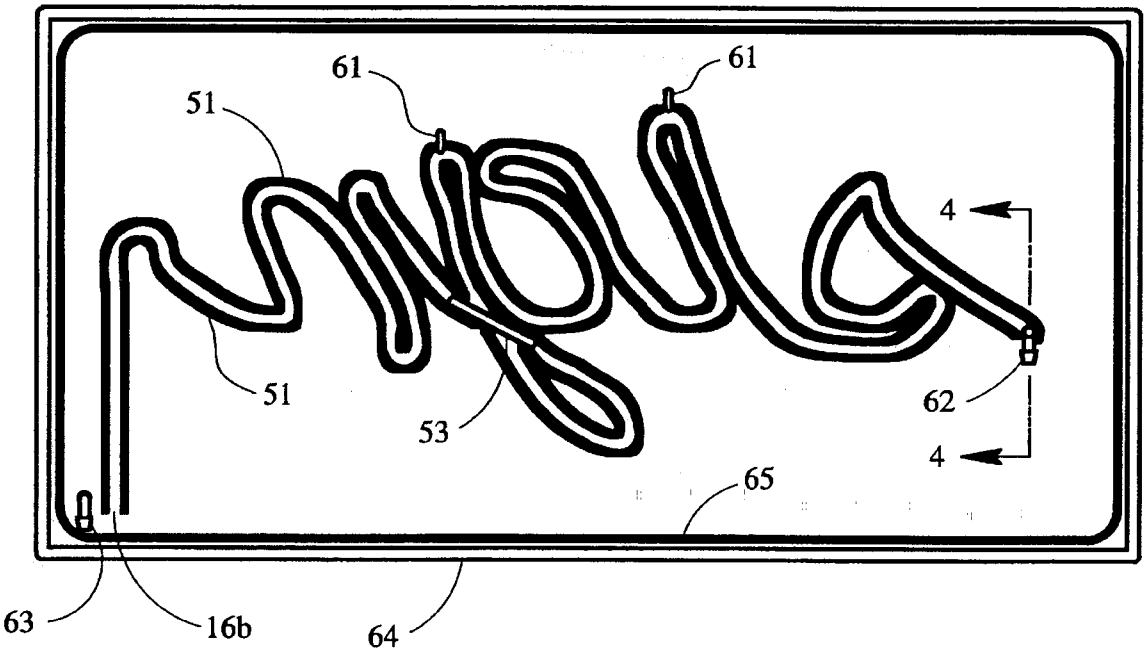
FIG. 3 is a back side view of the sign portion of the invention wherein the back-lighting components and the fluid circulating system mounted behind the sign of the invention are removed for purposes of illustration.

The sign disclosed in U.S. Pat. No. 5,075,992 comprises a transparent tube in which an electric gas discharge tube is encased in coaxial spaced relation to provide illumination for colored liquids which are circulated through the annulus between the two tubes. In the present invention, the sign 10 is a back-lit sign which uses fluorescent lamps 12 connectable to electric power by a cable 50 and mounted behind a pair of transparent panels 13, 14 which are bonded in parallel spaced relation to one another and house the fluids corridor 16. As shown in FIGS. 3 and 4, the corridor 16 is formed by an adhesive bead system 51 which bonds the panel 14 to the front display panel 13 and creates the offset distance between the panels. The bead system 51 is also formed as a pair of parallel tracks which are uniformly spaced to form the fluids corridor 16 therebetween. At one end the corridor is fitted with an entry barb 62 which is connectable to the entry conduit 17. The other end of the corridor 16 is in communication with the exit conduit 18 by means of an exit barb 63. As an alternative to the adhesive bead system, the fluids corridor might be formed by height modifications to one or both panels as by thermoforming or vacuum forming previous to the bonding of one panel to the other. However, the front visible surface of the front panel 13 is coated with paint or film 52, such as vinyl, which masks all but the lettering or other portions of the fluids corridor which form the illuminated sign.

Figure 5:
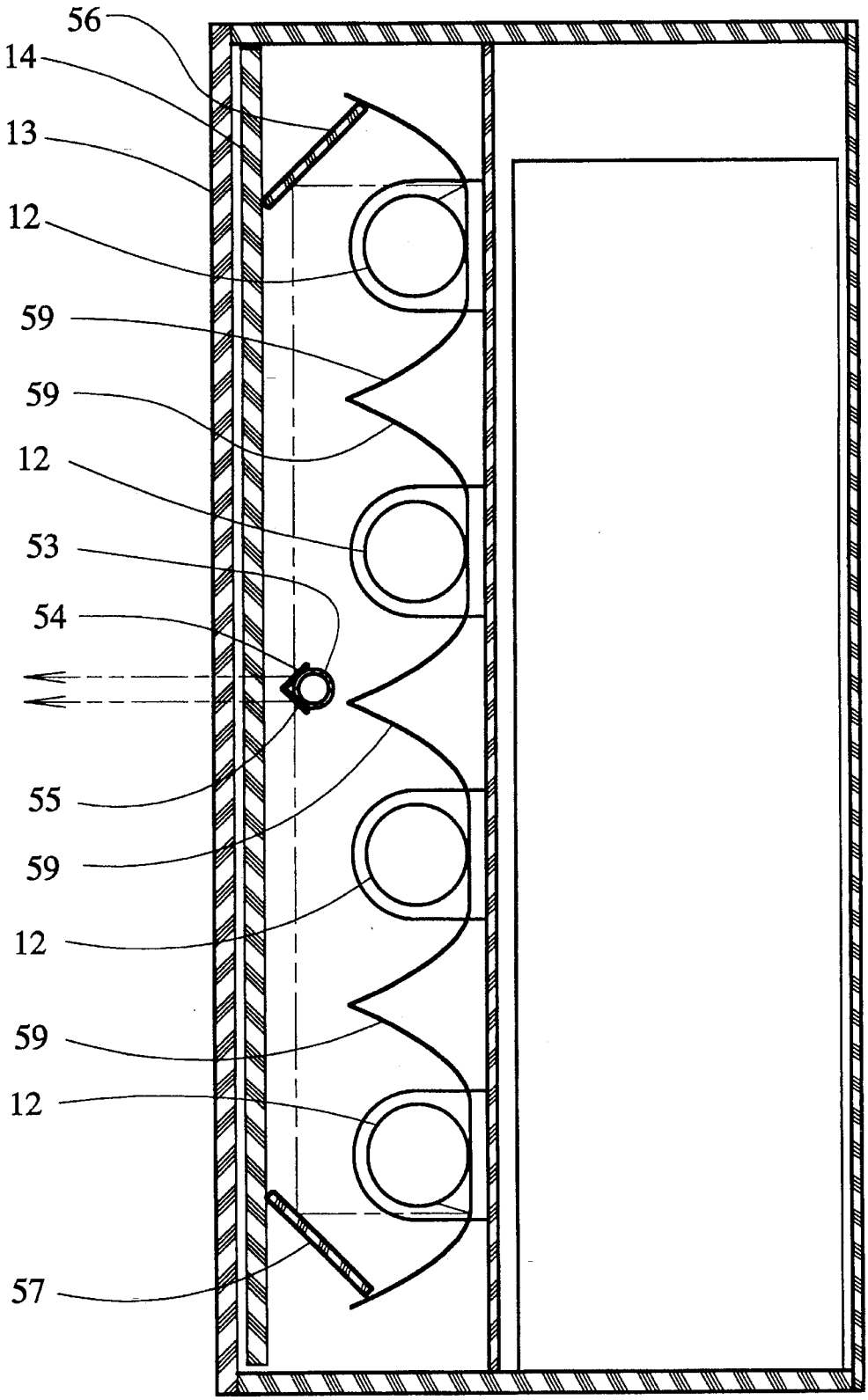
FIG. 5 is a fragmentary side view of the sign portion of the invention, showing a crossover bridge tube provided at an intersection of script in the sign.

It is to be appreciated that in certain configurations of the sign, such as script, there will appear to be intersections. Such intersections are avoided by the provision of crossover bridge tubes, such as the tube 53 shown in FIGS. 3 and 5, without which there would be an undesirable commingling of the different colored liquids as they are circulated in sequence through the fluids corridor. However, wherever a crossover bridge tube is provided at an intersection, a dark spot would appear in the lettering as viewed from the front even though the bridge tube is made of transparent material. In order to eliminate this dark spot, a "cloaking" system of mirrors is provided which directs the light from the fluorescent tubes around each bridge tube 53 such that the dark spots are eliminated. As shown in FIG. 5, the system comprises a pair of mirrors 54, 55 which are placed in perpendicular relationship to each other and in contact with a bridge tube 53. The mirrors 54, 55 are positioned behind the back panel 14 and bonded to the tube 53 with their reflecting surfaces facing towards the back panel 14 but at a 45° angle thereto. For each of the mirrors 54, 55, another larger mirror, such as the mirror 56, is mounted in parallel relation thereto but with its reflecting surface facing away from the panel 14. The larger mirror 56 is also located behind the back transparent panel 14 and mounted thereto by bonding or the like at a position between the panel 14 and the fluorescent lights 12 and at a distance convenient to the configuration of the sign lettering such that it does not lie directly behind any lettering. Another large mirror 57 is similarly located with respect to the mirror 55.

It will thus be seen that light from the fluorescent tubes and the parabolic reflectors 59 located behind them is reflected off the large mirror 56 and onto the small mirror 54 which then reflects that light through the transparent rear panel 14 and the fluids corridor 16. Light from the fluorescent tubes is also reflected off the large mirror 57 to the small mirror 55 from which it is directed through the panel 14 and the corridor 16. The reflected light through the fluids corridor 16 illuminates the sign lettering at the script intersection at which a dark spot would have otherwise appeared.

At certain points in the fluid corridor bubbles of air and sometimes bubbles of one of the colored liquids, an unclear liquid can become trapped and accumulate to a volume which causes an unsightly bubble in the lettering of the sign. After initial testing of a particular sign configuration, the location of these points can be determined. In order to continuously remove the bubbles from the fluids corridor 16, the design of the sign is altered as shown in FIG. 3 by a modification which provides a smaller version 61 of a crossover bridge tube at each of these trap points. Each tube 61, located entirely between the panels 13 and 14, is inserted through the adhesive bead system 51 with one end in communication with the fluids corridor 16 and its other end outside the corridor 16.

The design modification also involves mounting the exit barb 63 to the back sheet 14 of the panel assembly at a random point near the lower edge 64 of the sign instead of being directly attached to the end of the fluids corridor, the bead lines or ridges of which terminate at an open point just below the exit barb 63 within the space between the panels 13 and 14. The modification also comprises another adhesive bead line or thermoformed ridge 65 which is applied completely around the perimeter of the back sheet edge and between the panel sheets to create a trapped volume which is outside the fluid corridor 16. When the fluid circulating system is placed in operation, the suction from the pump on the exit barb 63 creates a partial vacuum in this region which draws the fluids out of the open exit end **16*b* of the fluid corridor. Also, at the air accumulation points, the smaller version 61 of the crossover bridge tube allows for a constant drawing of air and other undesired bubbles out of the fluid corridor and into the partial-vacuum region. The air gradually makes its way to the exit barb 63** and is drawn into the fluid circulating system.

Figure 6A:
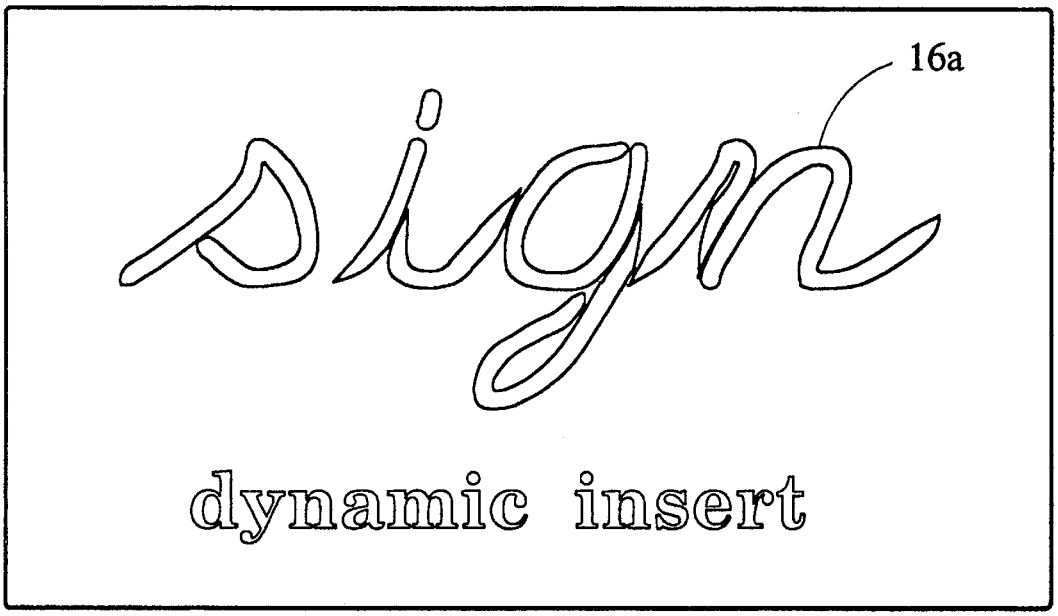
FIGS. 6A and 6B are front and rear views respectively, of a modified form of the sign component of the invention which is adapted to provide special dynamic effects in the sign.
Figure 6B:
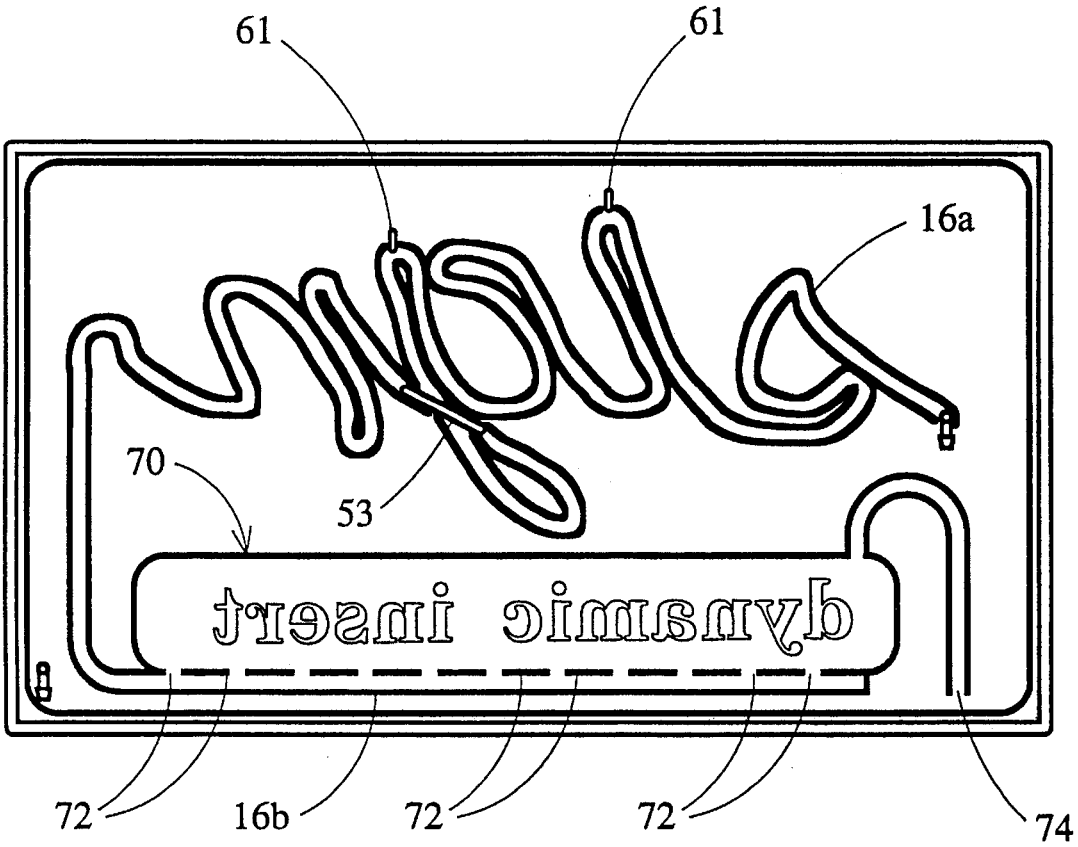

In addition to the "writing" effect created by the sequential flow of different colored liquids through the fluid corridor 16, the geometry of the adhesive bead 51 (or thermoformed ridges) which define the corridor may be designed to create effects such as a "raining" droplet region (for "raining" either up or down), or regions where the liquids replace each other in any of numerous ways. In the "raining" configuration as shown in FIGS. 6A and 6B, a region between the panel sheets 13, 14 designated to be behind a particular word or graphic shape is configured such that one of the liquids appears to remain relatively static while the other liquid is directed to "rain" drops or small streams through it. The fluid corridor **16*a*, after finishing its path through the "writing" portion of the sign, is channeled into a generally rectangular "raining chamber" 70 through a horizontal corridor 16*b* located below and contiguous to the rectangular chamber 70 although it could be above the chamber 70 as well. The adhesive bead/thermoformed ridge between the two is segmented such that small slots 72 spaced as required will direct the liquids through the slots and create either drops or small streams, depending on the width of the slot. When the fluid circulating system is placed in operation and the different colored liquids are flowed in sequence from the dispensing outlet 37 to the corridor 16*a*, the first colored liquid will then flow into horizontal corridor 16*b* and then fill the chamber 70. The second liquid of different color follows the first and as it is pumped through the system, will replace the first colored liquid in the corridor 16*a* and will "rain" droplets through the slots 72 into the liquid corridor chamber 70. Because of the large size of the chamber 70 in comparison to the slot openings 72, much of the chamber 70 is not in the direct line of flow between the slots 72 and the exit conduit 74 and will continue to occupy a large volume of the chamber 70 throughout the "raining" of the second liquid into the chamber. If the effect desired is to have the drops raining up, the horizontal corridor 16*b* is positioned below the "raining chamber" 70, and vice versa for raining down. At the opposite of the "raining chamber", the regular-width fluid corridor is attached and continues on to the corridor exit 74**.

Figure 7A:
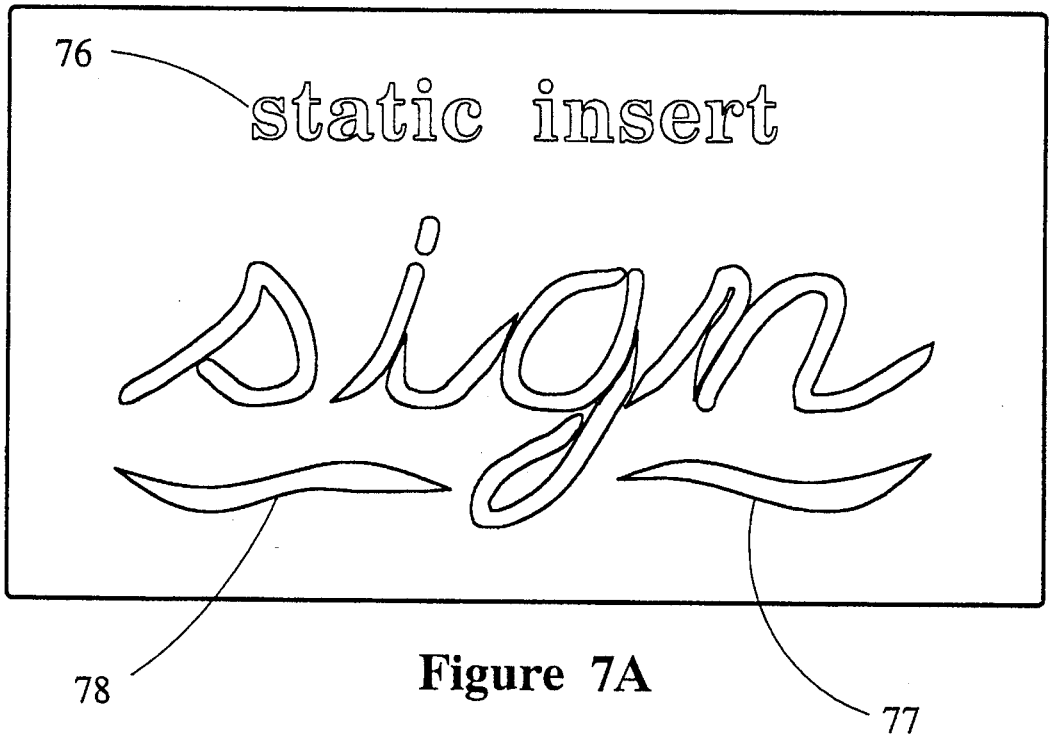
FIGS. 7A and 7B are front and rear views, respectively, of a modification of the invention wherein the sign component includes a combination of static and dynamic features.
Figure 7B:
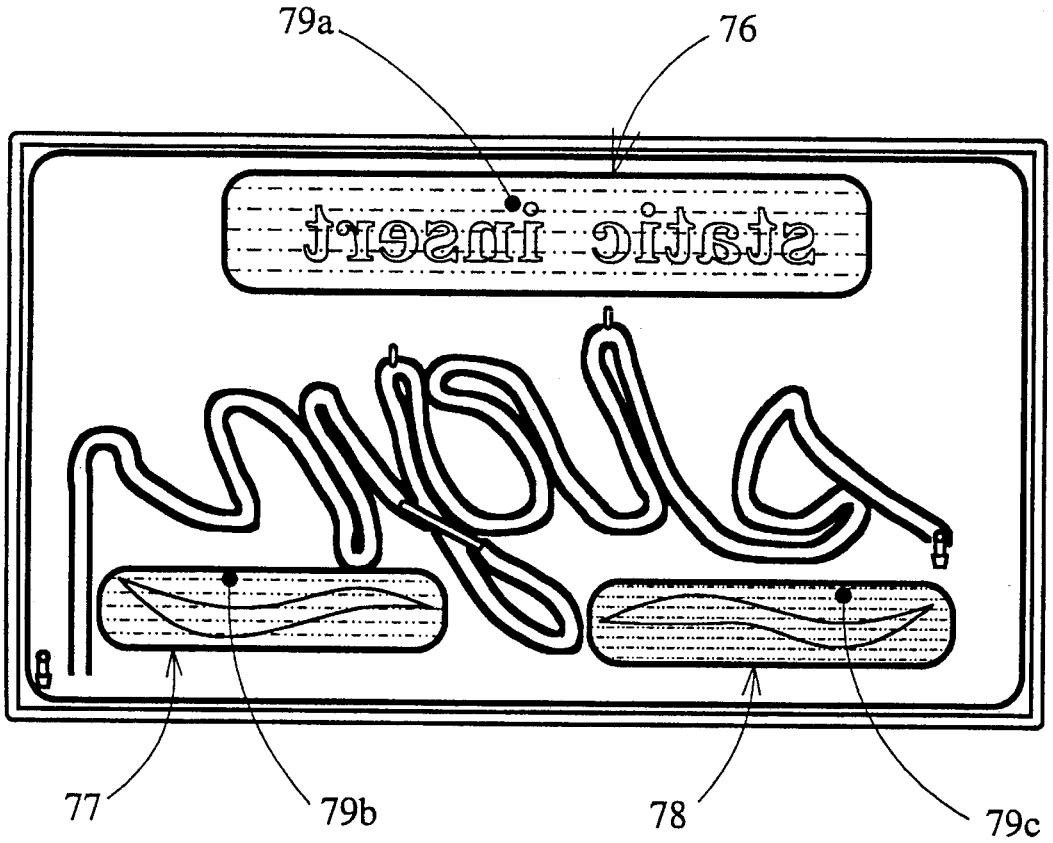

For other types of special effects, the fluid corridors can be channeled into and out of "block" regions in positions on the sides or top and bottom of the block region in a design with or without slots in the fluid corridor which will create a unique effect depending on how the geometry is configured. Also, since the fluids apparatus is limited to primarily two colors, if the sign desired needs any colors in addition to the two dynamic ones, it is possible to have some of the sign's words or graphics in static, additional colors, such as shown in FIGS. 7A and 7B. While the typical method of accomplishing this for a back-lit sign is to use a colored film or plastic, a slightly brighter and richer coloring effect is possible using a colored liquid such as water. The adhesive bead/thermoformed ridge pattern is designed such that a chamber or multiple chambers, such as chambers 76–78, are completely enclosed and separated from both the dynamic fluids corridor and the partial-vacuum region. The "static" chambers are filled through a fill-plug, such as the plugs 79*a*, 79*b*, and 79*c*, with water dyed to the desired color at manufacture and remain passive for the life span of the sign.

Figure 8:
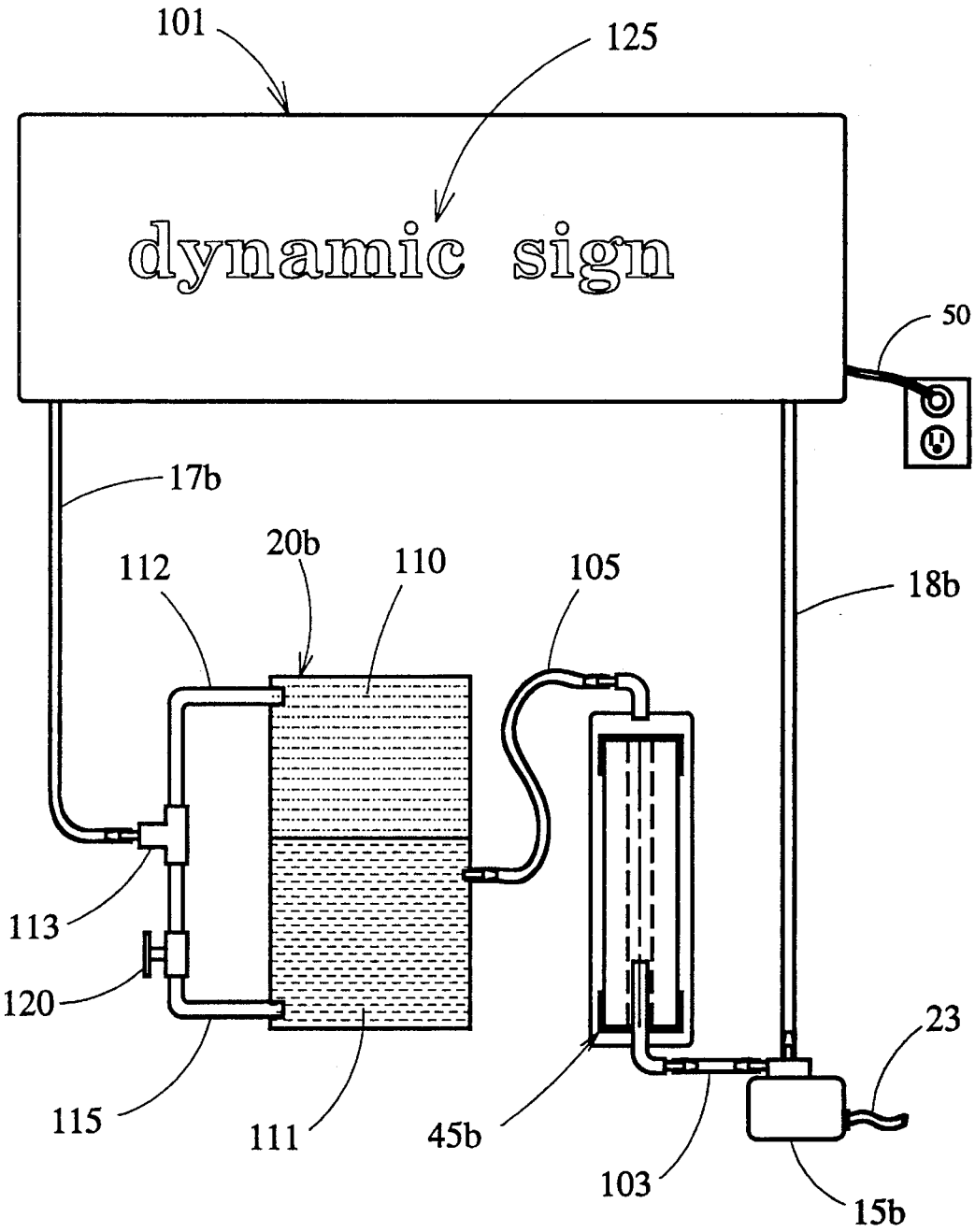
FIG. 8 is a further modification of the invention particularly adapted for displaying the "bubbling" or "raining" of one liquid into another.

A simplified fluid circulating system which can be used in another modification of the invention is disclosed in FIG. 8. The system therein comprises a display sign 101 wherein the fluid corridor between the panels of the panel assembly is configured to provide a dynamic insert with a "raining" chamber and slotted corridor as shown in FIG. 7B. An exit conduit 18B from the sign communicates liquids from the fluid corridor in the sign 101 to the inlet of an air-cooled pump 15B, the outlet of which is filtered by a filter 45B similar to the filters 45 shown in the apparatus in FIG. 1. The inlet of the filter 45B connects to the pump outlet by a conduit 103 and the filter outlet connects to a reservoir tank 20B by a conduit 105. Although the filter 45B is shown in a location outside of the tank 20B, it could also be located inside the tank as in the embodiment of the invention shown in FIG. 1.

Where two immiscible liquids of different specific gravity and color such as oil 110 and water 111, are supplied to the system they will stratify in the tank 20B as shown in FIG. 8. A duct 112 connected near the top of the tank 20B connects to the entry conduit 17B to the sign 101 via a tee joint 113 and thereby communicates the stratum of lightest liquid to the sign 101. In similar fashion, a duct 115 connects to the tank 20B near the bottom thereof and communicates the stratum of heaviest liquid in the tank 20B to the tee joint 113 and the entry conduit 17B, and the sign 101.

For controlling the proportionate flow of liquids from the reservoir to the sign 101, a manually adjustable ratio valve 120 is installed in the conduit 115. Then the different liquids are circulated through the system by operation of the pump 15B, the "raining" effect is produced in the dynamic insert 125 of the sign in the same manner as the "raining" effect is produced in the chamber 70 in the apparatus shown in FIGS. 6A and 6B.

It will therefore be seen that a new and improved multi-color liquid display system is disclosed herein which is particularly suited for use as a "writing" sign. It is capable of continuous operation for relatively long periods without degradation in the distinction of the colors of liquids and the delineation therebetween as the liquids move in sequence through the sign and the associated circulating system. It can also produce other effects such as the "bubbling" or "raining" of one colored liquid into a region or pool which contains a different color liquid. In addition, the "back-lit" feature with means for illuminating the intersections of script or other portions of the display and correcting for problems of aeration and commingling of liquids provide for a colorful and reliable display.

It is to be understood therefore that the foregoing description of a preferred embodiment of the invention has been presented for purposes of explanation and illustration and is not intended to limit the invention to the precise form disclosed. It is to be appreciated therefore, that various changes in materials and structure may be made by those skilled in the art without departing from the spirit of the invention.

I claim:

1. A multi-color liquid display system comprising a liquid conduit for receiving and conveying a liquid delivered thereto, said liquid conduit having an inlet end and an exit end;

display means operatively associated with said liquid conduit for effecting a visual display of liquid delivered to said liquid conduit;

a fluid circulating system which includes said liquid conduit, said circulating system including a reservoir tank;

a pump having its inlet connected to the exit end of said liquid conduit;

first and second immiscible liquids of different specific gravities and different colors disposed in said circulating system, said first and second liquids including portions thereof arranged in strata in said reservoir tank in order of their relative specific gravities;

a first communication means comprising a first duct for fluidly communicating the stratum of liquid of highest specific gravity in the reservoir tank with said inlet end of said liquid conduit;

a second communication means comprising a second duct for fluidly communicating the stratum of liquid of lowest specific gravity in the reservoir tank with said inlet end of said liquid conduit;

filter means connected to said reservoir tank and the outlet of said pump for filtering the fluids circulated in said fluid circulating system, said filter means comprising a filter having a porosity just large enough to allow passage of dye particles in said pair of liquids;

means including a ratio valve installed in said first communications means for selectively controlling the relative flow of said first and second liquids to said liquid conduit whereby said liquids are delivered to said liquid conduit in a selected proportion of their respective quantities, said display means comprising a transparent panel assembly wherein a pair of transparent panels are bonded in a substantially parallel and spaced relation to one another, with one of said panels providing a front display surface;

means in the space between said panels for defining said liquid conduit as a fluid corridor of a desired configuration;

lighting means mounted on said transparent panel assembly for directing light through said transparent panel assembly from the rear thereof; and means for masking all of said front panel display surface except for the portions thereof through which the fluid corridor is visible.

2. A multi-color liquid display system as set forth in claim 1 wherein said means for forming the fluid corridor is an adhesive bead system of substantially parallel bead lines which are spaced from one another to define said fluid corridor.

3. A multi-color liquid display system as set forth in claim 1 wherein said fluid corridor is configured as a sign in script form having one or more intersections of the script, and said display system includes transparent crossover tubes installed in said corridor at each of said script intersections to preclude mixing of liquids circulating through said corridor.

4. A multi-color liquid display system as set forth in claim 1 wherein said corridor is configured with a narrow portion and an enlarged chamber portion contiguous to said narrow portion of the corridor and wherein said narrow portion is provided with a plurality of slot openings for communicating with said enlarged chamber whereby a portion of said immiscible liquids may be conveyed by said circulating system and received in said enlarged chamber portion and a further portion of said immiscible liquids are flowed into the enlarged chamber portion of said corridor to simulate raining therein.

5. A multi-color liquid display system comprising a liquid conduit for receiving and conveying a liquid delivered thereto, said liquid conduit having an inlet end and an exit end;

display means operatively associated with said liquid conduit for effecting a visual display of liquid delivered to said liquid conduit;

a fluid circulating system which includes said liquid conduit, said circulating system including a reservoir tank;

a pump having its inlet connected to the exit end of said liquid conduit;

first and second immiscible liquids of different specific gravities and different colors disposed in said circulating system, said first and second immiscible liquids including portions thereof arranged in strata in said reservoir tank in order of their relative specific gravities;

means in said fluid circulating system for fluidly communicating each different colored stratum of liquid in the reservoir tank with the inlet end of said liquid conduit and sequentially circulating said first and second immiscible liquids in said system;

control ratio means installed in said fluid communication means for selectively controlling the flow of said different specific gravity liquids to said liquid conduit, said display means comprising a transparent panel assembly wherein a pair of transparent panels are bonded in substantially parallel and space relation to one another, with one of said panels providing a front display surface; and means in the space between said panels for defining said liquid conduit as a fluid corridor of a desired configuration, said fluid corridor being configured with a narrow corridor portion and an enlarged chamber portion contiguous to said narrow corridor portion and wherein said narrow portion is provided with a plurality of opening means for fluidly communicating with said enlarged chamber whereby the first of said immiscible liquids is adapted to be conveyed in said circulating system and a portion thereof received and retained in said enlarged chamber portion and portions of said second colored immiscible liquid may be flowed into the enlarged chamber portion of said corridor to simulate raining therein.

6. A multi-color liquid display system as set forth in claim 1 wherein said portions of second colored liquid flowed into the enlarged chamber portion of said corridor are in the form of droplets to simulate raining therein.

7. A multi-color liquid display system as set forth in claim 5 further including means for illuminating and directing light through said transparent panel assembly from the rear thereof.

* * * * *